US007448930B2

(12) United States Patent
Diggins

(10) Patent No.: US 7,448,930 B2
(45) Date of Patent: Nov. 11, 2008

(54) PADDLEWHEEL VESSEL THRUSTER

(76) Inventor: Peter Diggins, 3201 E. Mossman St., Tucson, AZ (US) 85706

( * ) Notice: Subject to any disclaimer, the term of this patent is extended or adjusted under 35 U.S.C. 154(b) by 0 days.

(21) Appl. No.: 11/193,893

(22) Filed: Jul. 29, 2005

(65) Prior Publication Data

US 2006/0025026 A1 Feb. 2, 2006

Related U.S. Application Data

(60) Provisional application No. 60/592,602, filed on Jul. 30, 2004.

(51) Int. Cl.
*B63H 5/02* (2006.01)
*B63H 5/03* (2006.01)

(52) U.S. Cl. ..... 440/90; 440/91; 440/98

(58) Field of Classification Search ..... 440/90–93, 440/95–100, 26–31; 415/5, 7; 416/102, 416/117, 119; D12/306
See application file for complete search history.

(56) References Cited

U.S. PATENT DOCUMENTS

| | | | | | |
|---|---|---|---|---|---|
| 243,535 | A | * | 6/1881 | Ewart | 440/91 |
| 254,878 | A | * | 3/1882 | Little | 114/246 |
| 416,323 | A | | 12/1889 | Collins | |
| 685,591 | A | | 10/1901 | Fernez-Breuer | |
| 1,155,654 | A | | 10/1915 | Greig | |
| 2,281,549 | A | * | 5/1942 | Arnold | 440/90 |
| 3,251,334 | A | * | 5/1966 | Beardsley | 440/90 |
| 4,832,642 | A | * | 5/1989 | Thompson | 440/90 |
| 5,782,660 | A | | 7/1998 | Brickell | |
| 5,785,564 | A | * | 7/1998 | Von Ohain et al. | 440/90 |
| 6,264,518 | B1 | | 7/2001 | Price | |
| 6,814,636 | B2 | | 11/2004 | Nolan | |
| 2004/0127115 | A1 | * | 7/2004 | Nolen | 440/53 |

FOREIGN PATENT DOCUMENTS

| | | | |
|---|---|---|---|
| DE | 3135643 A | * | 10/1983 |
| JP | 49083191 | * | 8/1974 |
| JP | 57015098 A | * | 1/1982 |

* cited by examiner

*Primary Examiner*—Ajay Vasudeva

(57) ABSTRACT

A paddlewheel thruster for propelling a marine vessel is provided with a trimming device to automatically trim the paddlewheel independently of the vessel. Automated trimming primarily achieved by means of a buoyant rudder and a fin and an articulated paddlewheel support. Augmentations including the use of sensors and control regulators are also disclosed.

8 Claims, 11 Drawing Sheets

FIGURE 3
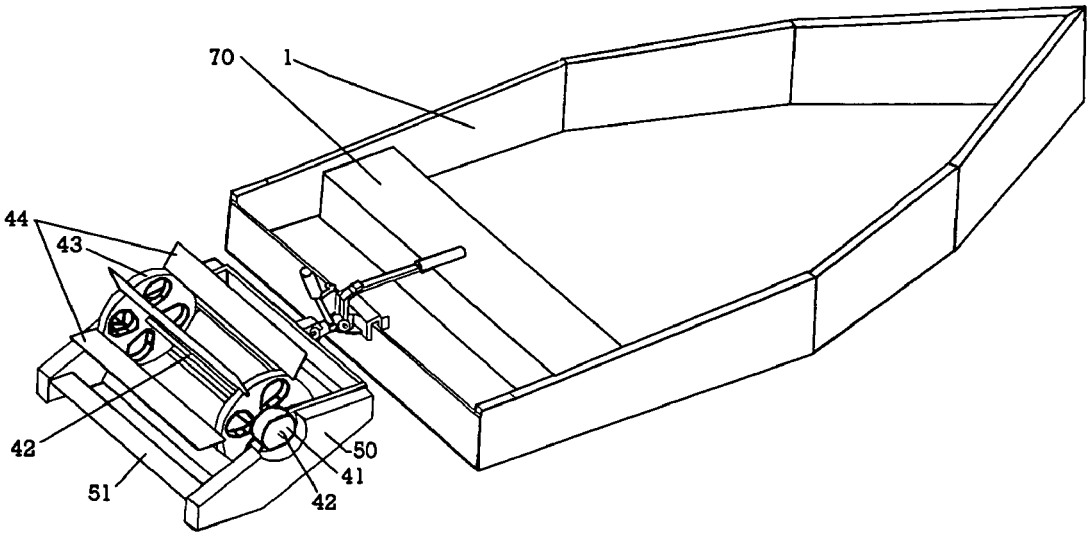
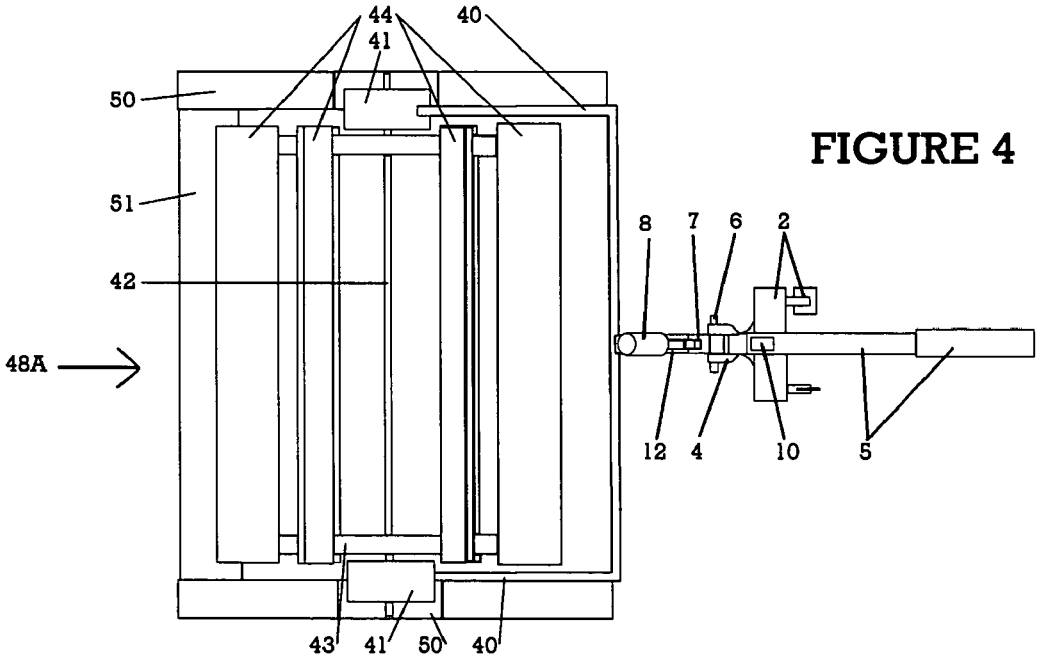
FIGURE 4

FIGURE 5
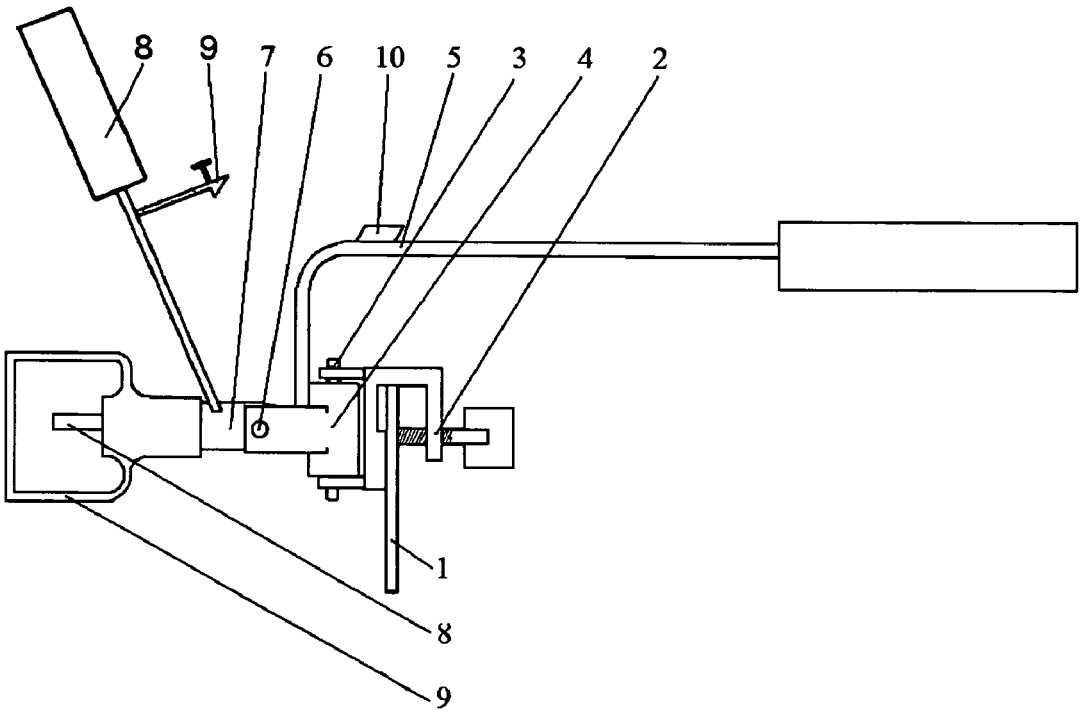
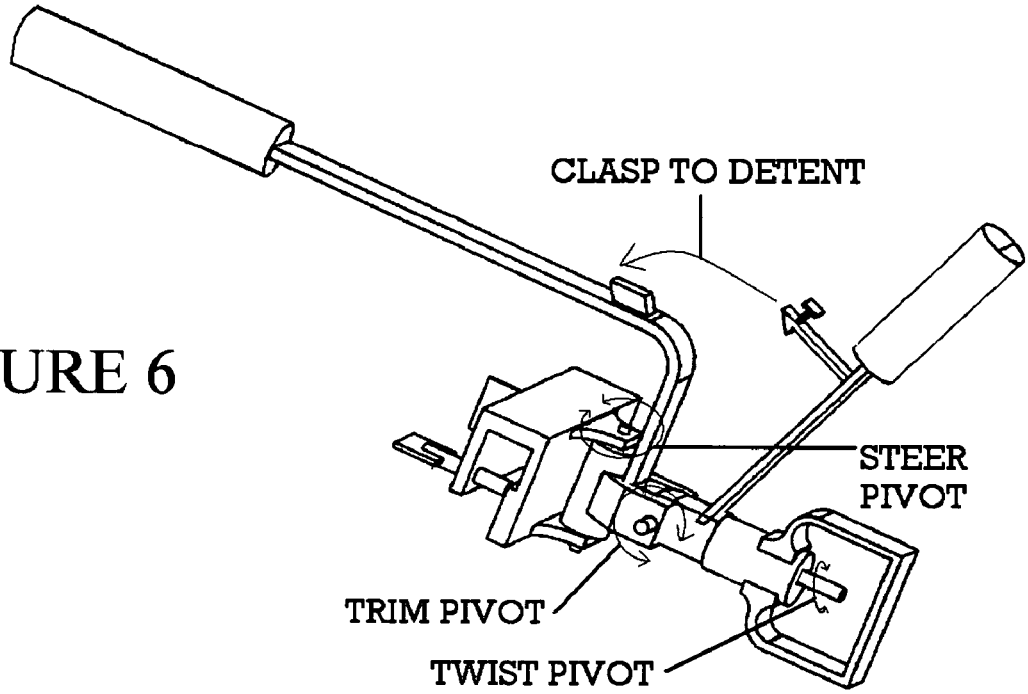
FIGURE 6

PADDLEWHEEL VESSEL THRUSTER

RELATED APPLICATION/CLAIM OF PRIORITY

This application is related to and claims the priority of Provisional Application No. 60/592,602, filed Jul. 30, 2004, and entitled Free Floating Powered Paddlewheel Vessel Thruster; and which provisional application is incorporated by reference herein.

BACKGROUND

The present invention provides new and useful concepts in paddlewheel vessel thrusters.

Vessels employing paddlewheels for propulsion have had the ability to reposition the paddlewheel assembly for almost as long as vessels have had paddlewheels.

Generally there are four reasons to enable the paddlewheel to be repositioned; the prime reasons being for trim and steering and lesser reasons being the ability to react if the paddlewheel strikes an object, and the ability to be stowed for storage or repair.

Paddlewheels for propulsion are trim sensitive because they rely on a small arc of the wheel to propel the vessel. An endless line paddlewheel is also trim sensitive because it is still dependent on arcs of wheels to dip the paddles.

Immersing too much of the paddlewheel wastes energy because the paddles are motivating the water in the wrong direction, i.e. down and up instead of the desired horizontal while being dipped.

Until now, generally, a great deal of engineering had been required to fit a vessel with a paddlewheel, there are however some designs where a paddlewheel thruster can be fitted to practically any vessel, but all paddlewheel thrusters had been substantially dependent on the displacement of the vessel and therefore required manual adjustment of the paddlewheel trim when the static displacement of the vessel is changed, i.e. the vessel is loaded or unloaded with passengers, cargo, fuel, etc. . . . further the displacement of a vessel is not static, nor are water conditions. It is believed that no prior art exists that addresses automatic trimming of paddlewheels thru changes in both the static and dynamic displacement of vessels as well as the effect of the dynamic environments seas present.

SUMMARY OF THE INVENTION

The present invention provides new and useful concepts in paddlewheel thrusters that address these and other issues. For example, the present invention provides new and useful concepts in paddlewheel thrusters designed to improve the energy efficiency of the thruster, and also to improve the environmental impact of the thruster.

One concept of the present invention provides a self trimming paddlewheel thruster for propelling a vessel, that comprises

- a rotatable paddlewheel,
- a paddlewheel drive that rotates the paddlewheel,
- a trim device configured to automatically trim the paddlewheel
- substantially independent of the displacement of a vessel in water,
- a support that interconnects the components of the thruster, and
- a connection device configured to connect the support with a vessel in a manner that allows the thruster to trim.

Another concept of the present invention provides a paddlewheel thruster for propelling a vessel, comprising

- a rotatable paddlewheel,
- a paddlewheel drive that rotates the paddlewheel,
- a connection to a vessel,
- a support for the paddlewheel and
- a fin connected with the support and configured to be located behind the paddlewheel to provide some lift to the paddlewheel and to provide some direction to the water leaving the paddlewheel when the paddlewheel is moving in a body of water.

DEFINITIONS

In this application:

A paddlewheel that can "automatically trim substantially independently of the displacement of the vessel" means that the paddlewheel is connected with the vessel in a manner that enables the paddlewheel to automatically find an equilibrium with the water body in which the paddlewheel is immersed, apart from the displacement of the vessel, but because the paddlewheel is connected with the vessel, the paddlewheel would obviously be affected if there were a dramatic change in the displacement of the vessel (e.g. if the vessel were to sink, be overturned, etc).

"A Vessel", any object that floats on water, capable of being propelled, including a boat, ship, ice bergs, logs, etc. . . . that is powered or not.

"Water or Seas" means a liquid fluid that a vessel floats upon.

"A Thruster", means a device that provides propulsion to a vessel.

"A Paddlewheel" means any Device wherein the means to provide the motive force for a vessel is a wheel having a number of planar water contacting blades extending therefrom and any Device wherein the means to provide the motive force is a pliable, continuous member such as a chain or a belt having planar water contacting blades extending there from, entrained around a series of wheellike objects.

"A Paddlewheel Drive" means any form of drive from a source of power to the paddlewheel or any form of drive train from a source of power to the paddlewheel that applies a torque to the paddlewheel or paddlewheel support to rotate the paddlewheel.

"Trim" means equilibrium with the water body in which the paddlewheel is immersed allowing optimal thrust generation.

"A Trim Device" means a device or system of devices that automatically adjusts the engagement of the paddlewheel to water, substantially regardless of the displacement or speed of the vessel and sea conditions.

"A Support" means a device that interconnects and constraints other structures.

"Connection with", means directly connected, or connected through one or more intermediate members.

"A Connection with a Vessel" means a form of attachment to a vessel that allows movement of the support of the thruster, i.e. the support, paddlewheel, etc. Movement is to include pivotal and linear motion.

"A Buoyant Mass" means a mass having a low weight to volume ratio so that it floats on water and is capable of adding buoyancy to what it is connected with.

"A Rudder" means a device that directs water as it flows past it, generally configured on a vertical plain and having a thin width and a length and height, the water imparting a motive force to the rudder used for steering a vessel.

"A Fin" means a device that is affects and is affected by water as water flows past it; the fin generally configured on a horizontal plane and having a thin height and a length and width, the flowing water imparting a motive force to the fin used for positive or negative lift imparted to what the fin is attached to.

"A Sensor" means a device capable of producing a variable signal dependent upon its sensed environment, the signal being used as an input by a control device that regulates another device.

"A Control" means any device that regulates the relative motion of two connected structures, the regulation being dependent on an input.

"Control Processor" means a device that transforms, amplifies or modifies signals from a sensor or sensors and manual input devices to drive controls.

"A causal system" means a system that can react to an indirect cause, which is the ability to react to a sensed cause prior to the cause affecting the reactor.

"Counterbalance", means a device connected with a structure that offsets the effective weight of the structure thru design layout or effect, changing the center of gravity of the structure, ideally creating a balance moment over a connection with the structure.

"Removably Attachable" means a connection of two structures that is not permanent or is semi-permanent.

"An Energy Storage Device" means a device capable of storing energy; i.e. a fuel tank, a battery, etc. . . .

"An Electricity Producing Transducer" means a device that transforms another form of energy into electricity; i.e. a photovoltaic device, etc. . . .

The foregoing and other aspects of the present invention will become further apparent from the following detailed description and the accompanying drawings.

BRIEF DESCRIPTION OF THE DRAWINGS

FIG. 3 discloses a boat with a self trimming paddlewheel thruster with a fin;

FIG. 4 shows a top view of the thruster of FIG. 3

FIG. 5 is a view of a self trimming paddlewheel thruster's connection with a vessel;

FIG. 6 indicates a range of motions allowed by a connection with a vessel;

DETAILED DESCRIPTION

As discussed above, the present invention relates to new and useful concepts in paddlewheel thrusters. The principles of the invention are described below in connection with several examples of a paddlewheel thruster, and from these descriptions the manner in which the principles of the present invention can be applied to various types of paddlewheel thrusters will become apparent to those in the art.

Figure 1:
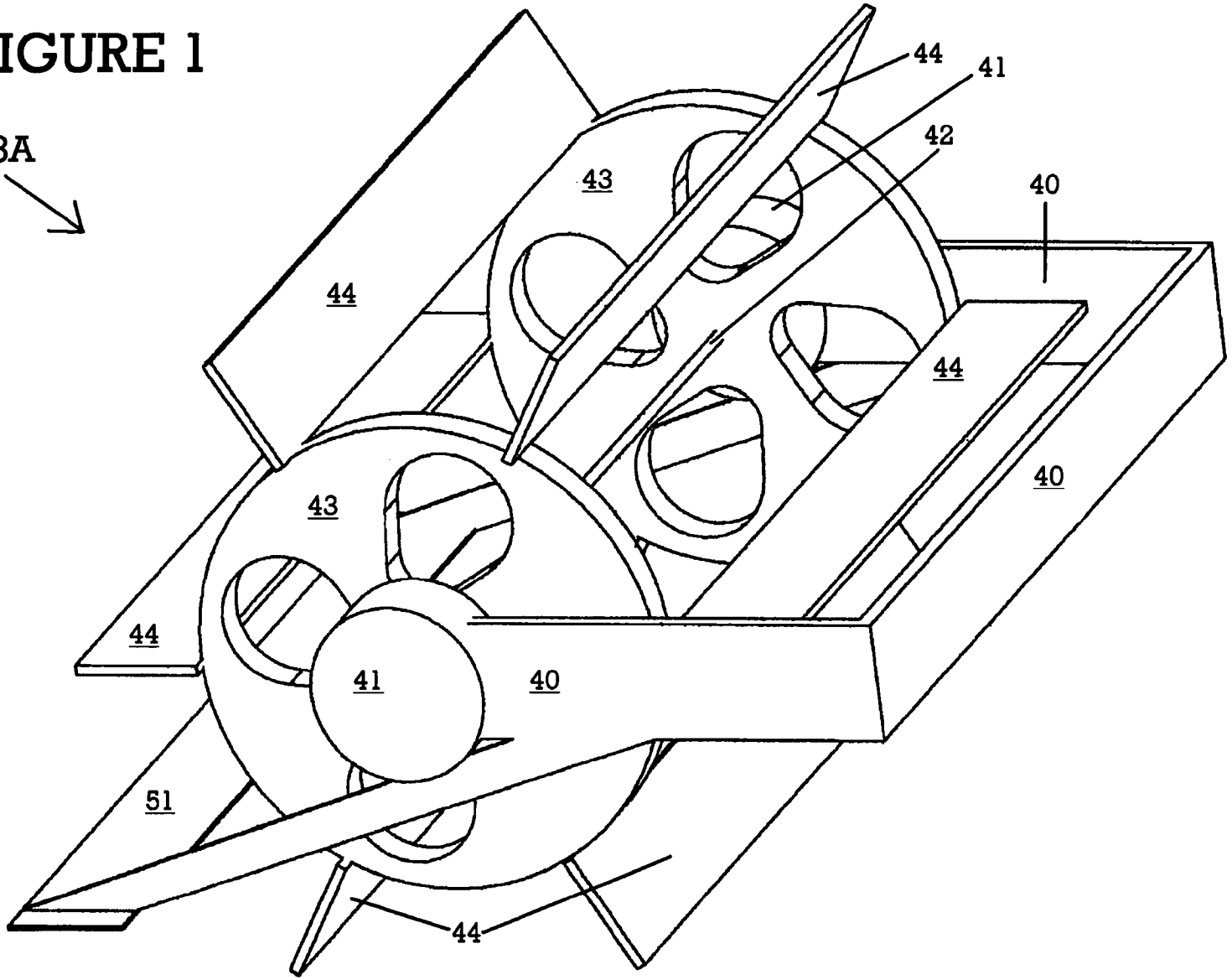
FIG. 1 (first embodiment) shows a paddlewheel assembly with a fin behind it.

As seen in FIG. 1 a paddlewheel assembly (48A) comprises a support (40) that enables the paddlewheel assembly (48A) a connection with a vessel (1) and connects to motors (41) that support and drive an axle (42). The axle (42) has wheels (43) fastened to rotate with the axle (42) and a plurality of paddles (44) is retained in a fixed orientation to the wheels (43). The support (40) also attaches a fin (51) in a fixed orientation behind the paddles (44) and wheels (43) in a low area so that when the motor (41) rotates some of the paddles (44) are dipped in water imparting force to the water and the fin (51) directs the flow of water leaving the paddlewheel.

Figure 2:
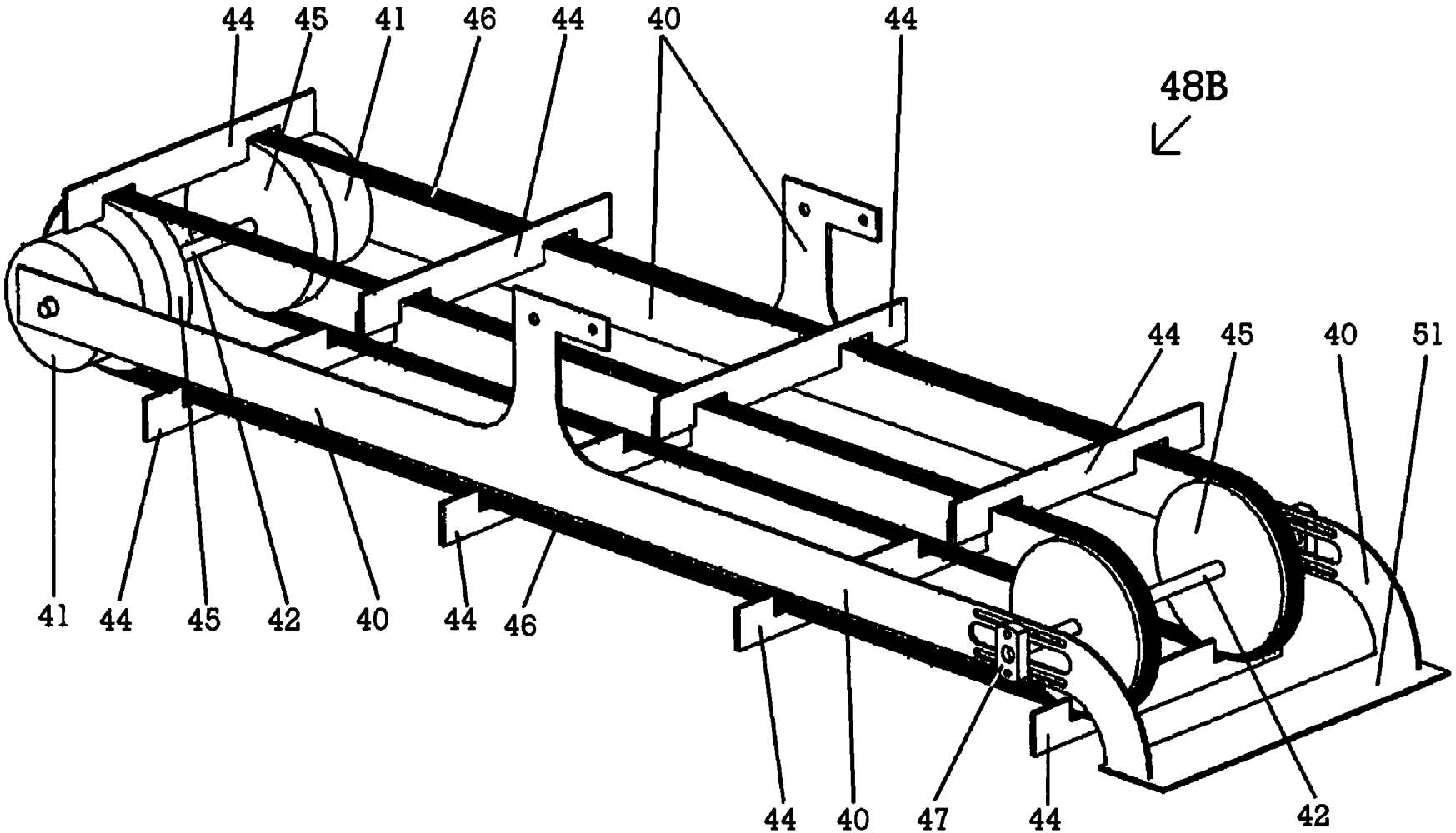
FIG. 2 (second embodiment) illustrates an endless line paddlewheel assembly with a fin behind.
Figure 7:
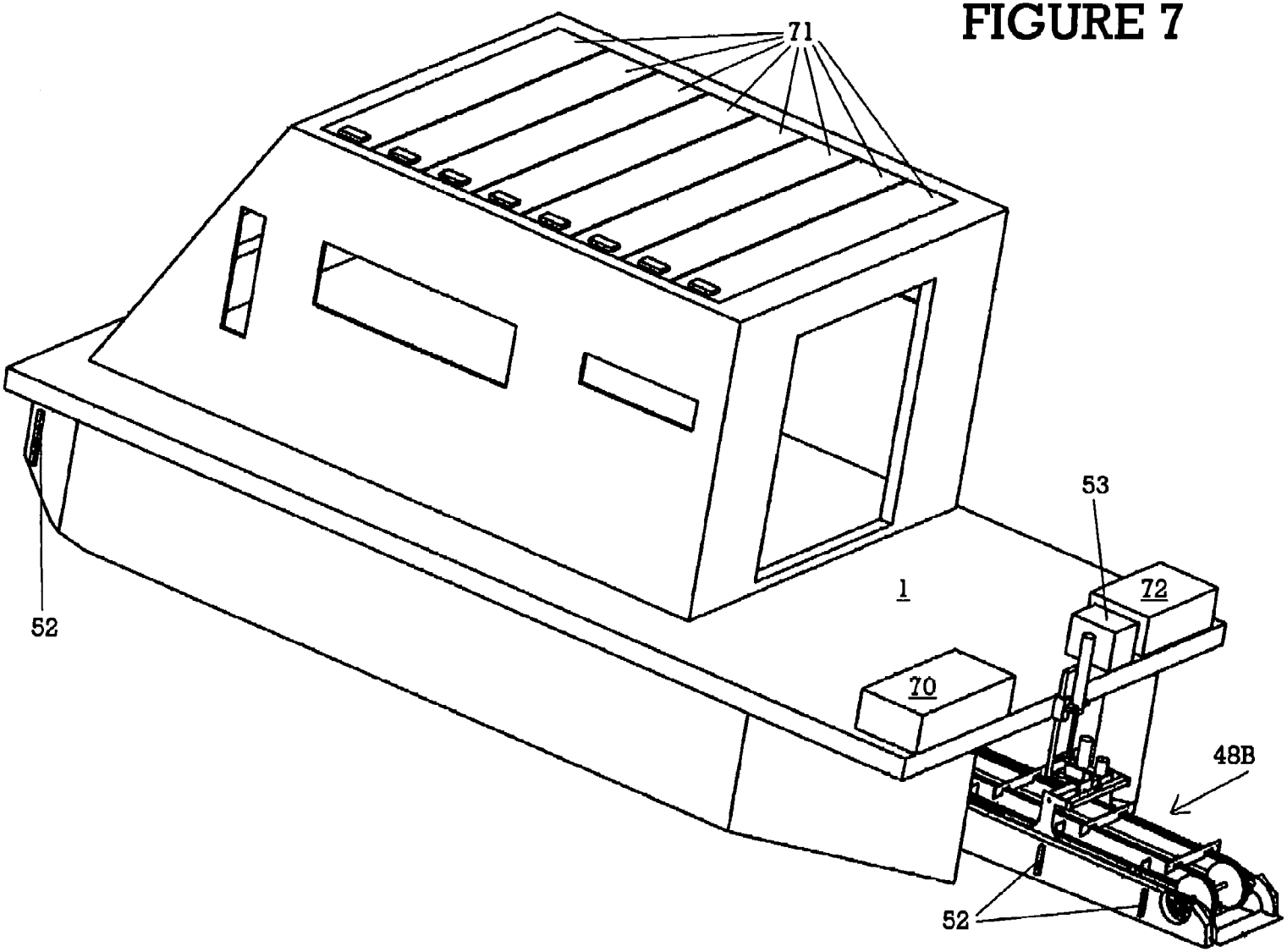
FIG. 7 is of a houseboat with an endless line self trimming paddlewheel thruster.

As seen in FIG. 2 an endless line paddlewheel assembly (48B) comprises a support (40) that enables the paddlewheel assembly (48B) a connection with a vessel and connects to motors (41) that drives a front axle (42). The axle (42) has sheaves (45) attached to rotate with the axle (42). A rear axle (42) that has sheaves (45) and is adjustably connected to the support (40) with pillow block bearings (47). Two endless belts (46) are tensioned around the sheaves (45) by the adjustment of the rear axle (42). A plurality of paddles (44) is spaced along and attached to the belts (46). The support (40) also attaches a fin (51) in a fixed orientation behind the paddles (44) in a low area so that when the motor (41) rotates some of the paddles (44) are dipped in and move through water imparting force to the water and the fin (51) directs the flow of water leaving the paddlewheel.

Figure 11:
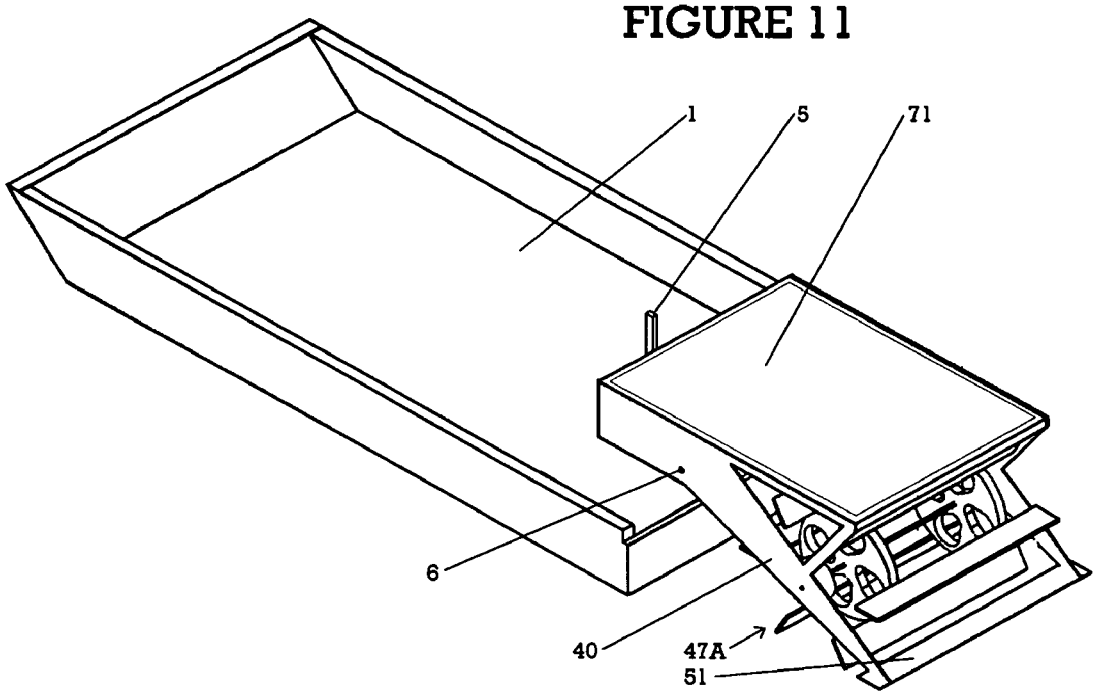
FIG. 11 shows a self powered paddlewheel thruster with a solar panel and with a balance moment over a connection with a vessel.
Figure 12:
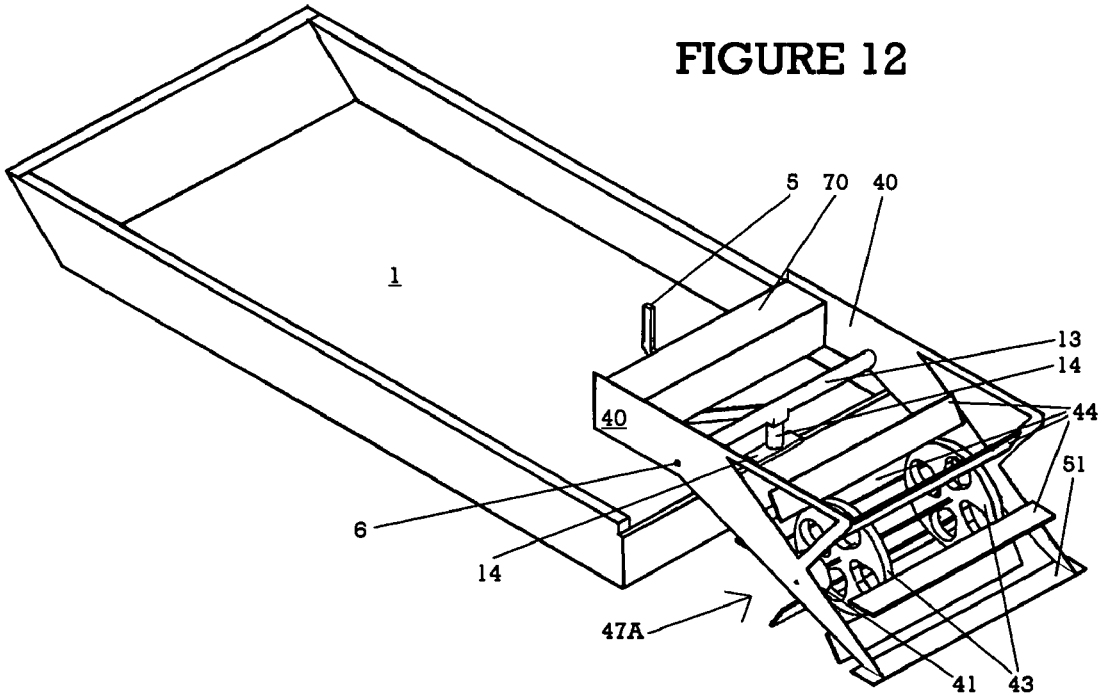
FIG. 12 is a view of the thruster of FIG. 11, with the solar panel removed showing the connection.

As seen in FIGS. 11 and 12 a paddlewheel assembly is configured to have a balance moment over a connection with a vessel (1) and has batteries (70) and a solar panel (71). A flange (14) is bolted to the vessel (1). The flange (14) having a hollow cylinder protruding vertically up that receives a shaft protruding vertically down from a trim tube (13). The cylinder of the flange (14) and shaft of the trim tube (13) forming a pivot that retains the balance of the thruster to the vessel. The trim tube (13) having a lever protruding forward forming a tiller (5) handle for control of steering. The trim tube (13) spans the distance between the supports (40) of a paddlewheel assembly (48A). The support (40) being drilled so that a trim pin (6) can pass through it and the trim tube (13) retaining them to each other and allowing the support (40) to pivot horizontally for trim. The support (40) being lengthened forward over the connection to attach a battery (70) that provides power for the thruster and also acts as a counterbalance to the paddlewheel assembly (48A). The support (40) also attaches a fin (51). The support (40) is also adapted to attach a solar panel (71) that provides power to charge the battery. The electrical devices are connected with cables (not shown).

In application the vessel (1) is floating in water and the paddlewheel is turning with the power provided from the battery (70) to the motor (41), via cables (not shown). The paddlewheel interacts with the water causing the vessel (1) to be propelled and causing water to flow past the fin (51) causing the fin (51) to provide lift to the support (40), trimming the paddlewheels interaction with the water with the assistance of the balance moment provided to the support (40) over the connection with the vessel (1) by the counterbalance effect of the battery (70). Steering is achieved by the vessel operator manipulating the tiller (5) handle causing the thrust generated by the paddlewheel to be directionally applied to the vessel (1).

As seen in FIGS. 3 thru 6 the connection with the vessel (1) comprises a clamp (2) for attachment to the vessel (1). The clamp (2) has two flanges with holes drilled in them for a steering pin (3). The steering pin (3) passes through the holes and thru a steering swivel (4), allowing the steering swivel (4) to pivot vertically to the clamp (2) and the vessel (1) for steering. The steering swivel (7) has a lever attached to it that acts as a tiller (5) handle. The steering swivel (4) also has two flanges with holes drilled in them for a trim pin (6). The trim pin (6) passes through the holes and through a trim swivel (7), allowing the trim swivel (7) to pivot horizontally to the steering swivel (4) for trim. The trim swivel (7) has a lever attached to it that acts as a stow (8) handle and has a clasp (9) that can clasp onto a detent (10) on the tiller (5) handle for retention of the support (4) to a stowed state. The trim swivel (7) has a twist pin (11) protruding rearward from it, which passes thru a twist swivel (12), so that the twist swivel (12) pivots laterally to the trim swivel (7). The twist swivel (11) has a flange that connects to the support (40).

The paddlewheel assembly (48A) as described above, further comprises a buoyant mass (50) attached to the support (40), so that some of the paddles (44) of the paddlewheel are floated in a trimmed state when the paddlewheel assembly (48A) is not stowed.

The vessel (1) has aboard a battery (70) that is connected to the thruster's motors (41) via a cable (not shown) with a switch (not shown).

In application the thruster is attached by the clamp (2) to a vessel (1) that is floating in water. An operator defeats the stow function by working the clasp (9) from the detent (10) and lowers the thruster with the stow (8) handle. The Thruster being lowered from the stowed position, the buoyant masses (50) float the paddlewheel assembly (48A) in a trimmed state in the water. The operator activates the motors (41) with the switch (not shown) and power is supplied from the battery (70) via the cables (not shown) causing the paddlewheel to rotate, providing thrust to the vessel (1) by the interaction of the paddlewheel to the water. The fin (51) provides lift assisting the buoyant masses (50) in retaining the paddlewheel assembly (48A) in a trimmed state as the vessel (1) and thruster accelerates. The operator works the tiller (5) handle to steer the vessel (1), directionally apply the thrust provided by the paddlewheel and the buoyant masses (50) in the shape of rudders assist in steering the vessel (1). Should the vessel (1) encounter waves, the motion allowed with the twist swivel (12) and trim swivel (7) allows the thruster to twist and trim independently from the vessel. Should the paddlewheel assembly (48A) strike an object, the motion allowed with the twist swivel (12) and trim swivel (7) allows the thruster to react independently from the vessel, reducing the likelihood of damage to the vessel (1) and thruster. The fin (51) also provides direction to the water leaving the paddlewheel (30), reducing the ability of the paddlewheel (30) to raise the water thereby reducing the wave pattern formed from the interaction of the water and the rotating paddles (44).

FIGS. 7 thru 10 are of a computer controllable self trimming endless line paddlewheel thruster connected to a vessel (1). A buoyant mass (50) is attached to each of the supports (40) of paddlewheel assembly (48B). A pair of water level sensors (52) is fastened to one of the buoyant masses (50). The supports (40) are attached to a connection with the vessel (1) as further described. A trim slide bar retainer (15) is wielded to a central stern location of the vessels (1) bridge framework. A trim slide bar (16) is allowed only vertical travel through the trim slide bar retainer (15). The lower portion of the trim slide bar (16) has two flanges that connect to the output shaft (18) of a steering effecter (17). A twist channel (19) is fastened to the bottom of the steering effecter (17) and is drilled to accept a twist pin (11). A twist bar (21) is drilled to accept the twist pin (11), allowing the thruster to pivot laterally in respect to the vessel (1). The twist bar (21) spans the distance between the supports (40), and are drilled and taped to accept bolts that act as attitude pins (22). The supports (40) are also drilled to accept the attitude pins (22) forming a pivot. The slide bar retainer (15) and the slide bar (16) are further adapted to support a trim actuator (27). The trim actuator (27) is a dual action pneumatic ram with integral pump and valves. An attitude bar (23) spans the distance between the supports and is drilled and threaded to accept bolts that act as attitude pins (22). The support is also drilled to accept the attitude pins (22) forming a second pivoting span between the supports. The steering effecter (17) and the attitude bar (23) are adapted to accept an attitude servo (28). The attitude servo (28) is a dual action pneumatic ram with an integral electric pump and valves. Cables (not shown) connect the electric devices and the vessel (1).

The vessel (1) has a bow wave sensor (52) that detects the magnitude of waves impacting the bow of the vessel, batteries (70), solar panels (71), a diesel generator (72), a dual mode control processor (53) and cables (not shown).

In application the self trimming paddlewheel thruster can run in two modes, a computer controlled mode, and a non-computer mode that relies solely on the buoyant mass and fin for trim. The control processor (53) drives the drive motor (41), the steering effecter (17), the trim actuator (27) and the attitude servo (28) with energy provided by the batteries (70) or generator (72). In the computer controlled mode, the control processor (53) receives input from the sensors (52) and user input devices, and adaptively drives the devices (41, 17, 27, 28) to achieve optimal performance to a user defined specification. In the non computer controlled mode the control processor still controls the drive motor (41) and steering effecter (17), but the trim actuator (27) and attitude servo (28) are defeated and act only as motion dampeners.

The output shaft (18) of the steering effecter (17) acts as a regulated pivot allowing the support (40) to pivot vertically so that the thruster can directionally apply thrust to the vessel (1) for steering. The trim actuator (27) assists the buoyant masses (50) by modifying the effective weight of the paddlewheel assembly (48B) and that can also lift the paddlewheel assembly (48B) out of the water for storage. The attitude servo (28) assists the buoyant masses (50) by modifying their inclination to the water or acts a motion dampener.

Figure 8:
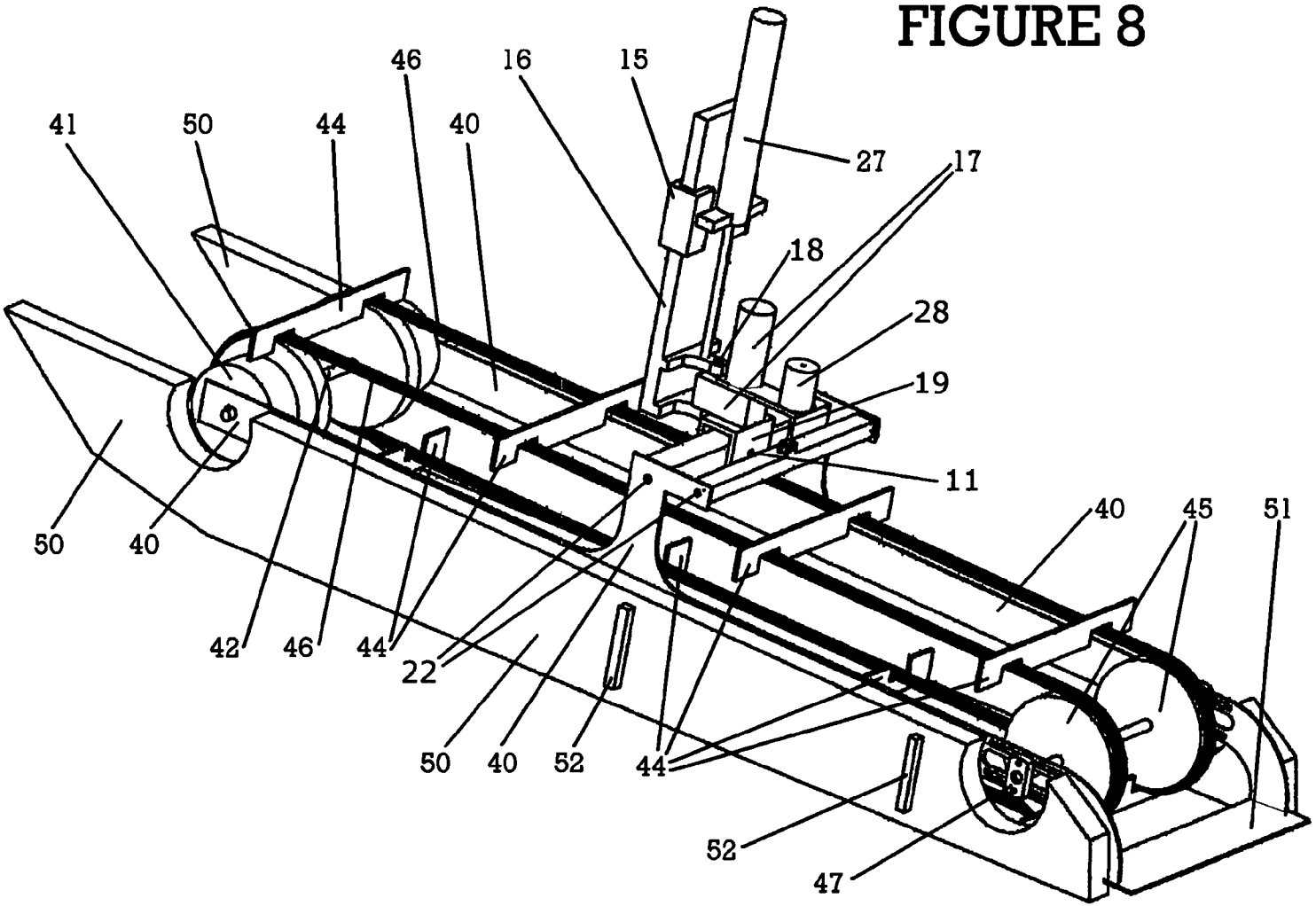
FIG. 8 illustrates a self trimming thruster.
Figure 9:
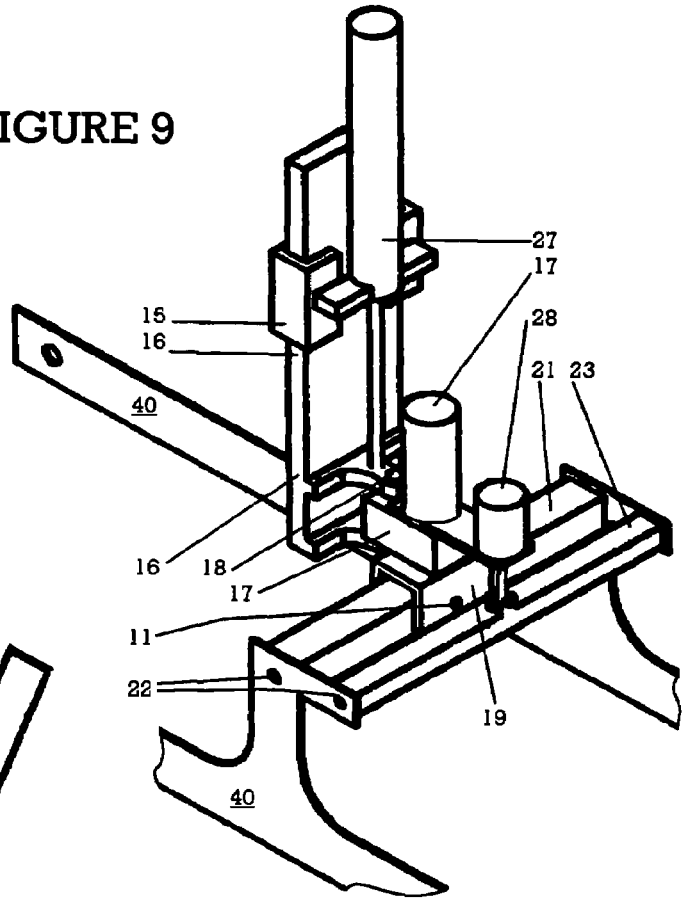
FIG. 9 illustrates a thruster's connection with a vessel.
Figure 10:
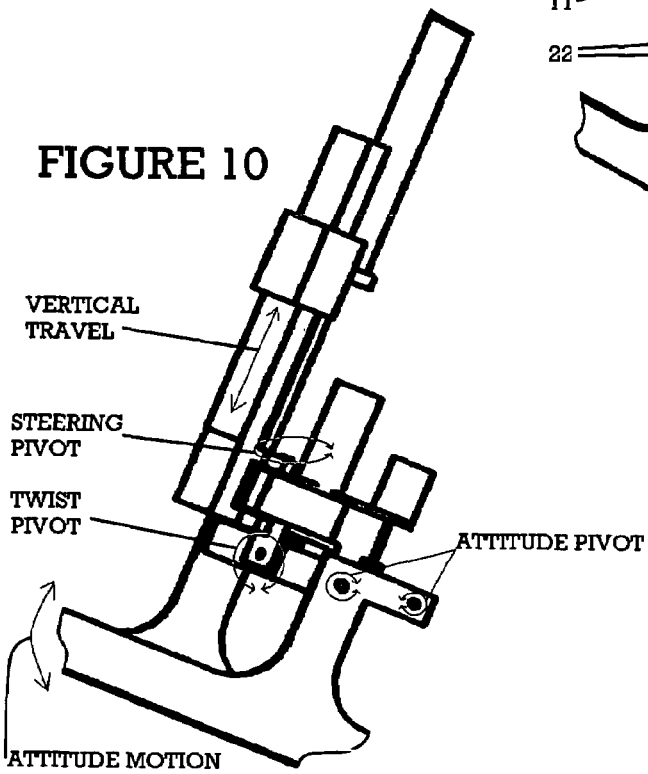
FIG. 10 shows a range of motions allowed by a connection.
Figure 13:
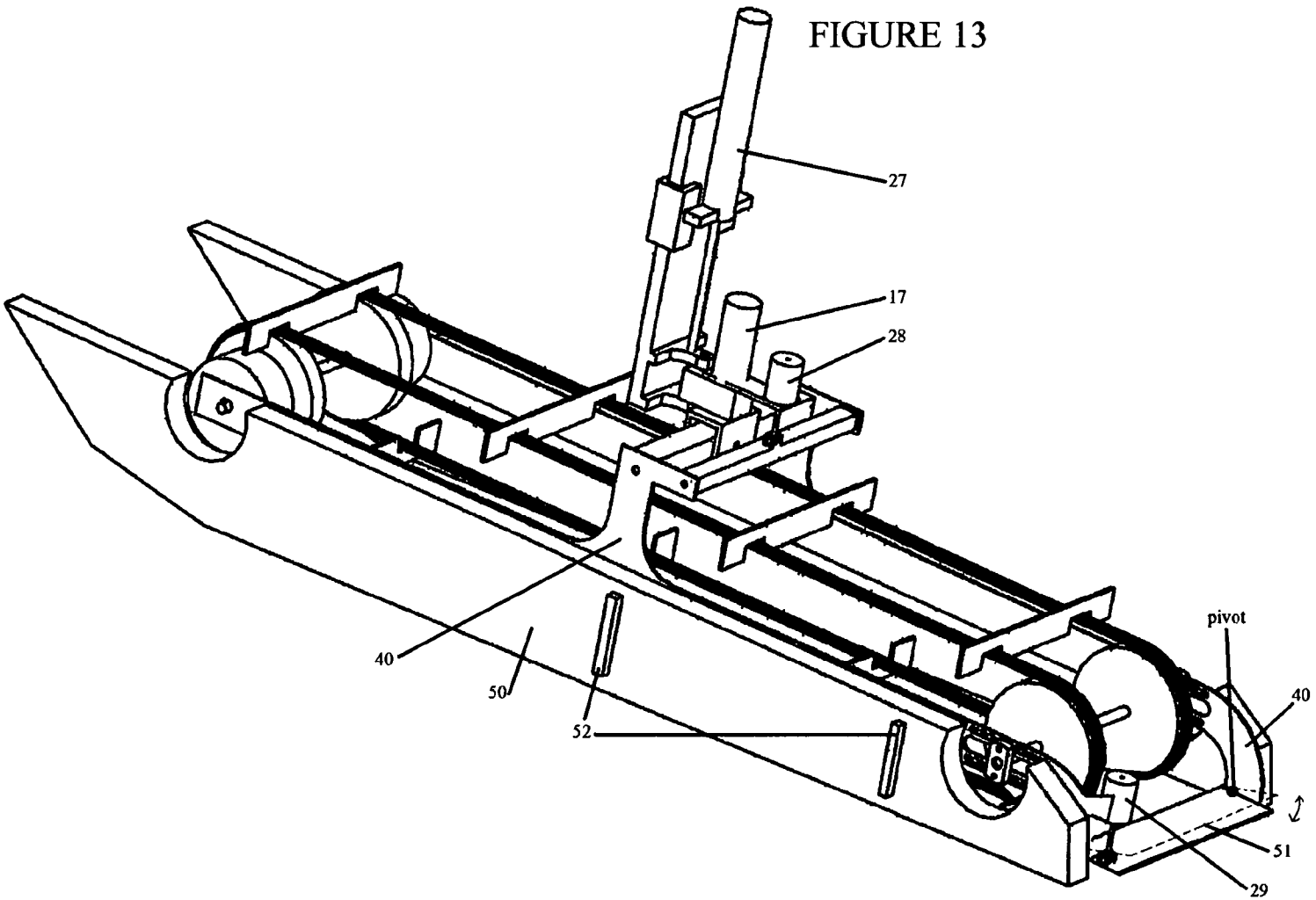
FIG. 13 shows a highly tunable thruster.

The proceeding embodiment of a self trimming endless line paddlewheel thruster, FIG. 8 includes an attitude servo (28) that acts to change the inclination of the support (40), there by changing the inclination of the fin (51) and the endless line paddlewheel to the water. However as shown in FIG. 13 the fin (51) can be attached to the support (40) with an ability to pivot. Incorporation of a fin positioner (29) that is attached to support (40) and configured regulate the fin (51) and connection with the control processor (53) adds further control of trimming, the direction of water leaving the paddlewheel, and thereby waves produced by the thruster.

Figure 14:
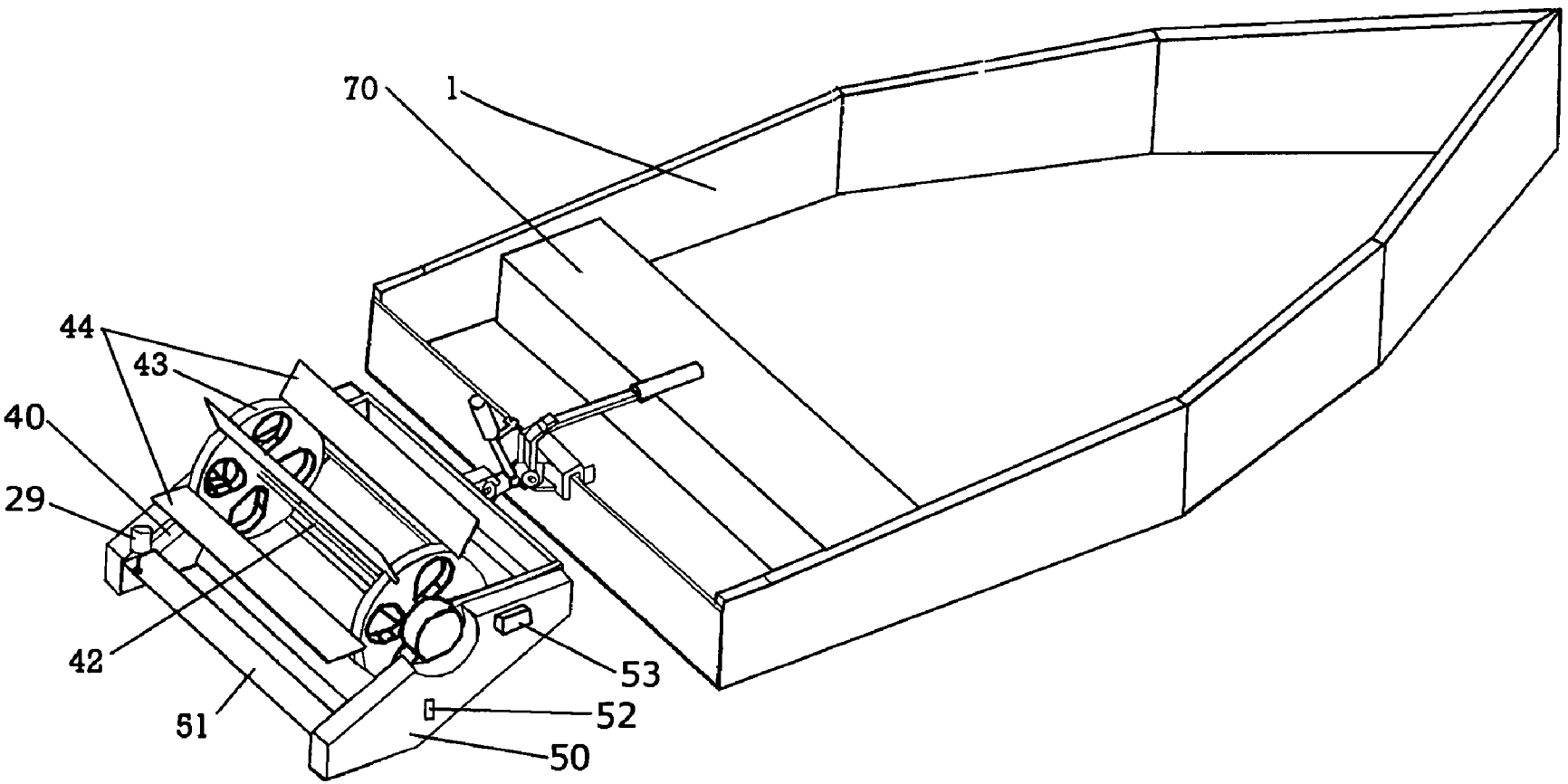
FIG. 14 shows a highly tunable thruster.
Figure 15:
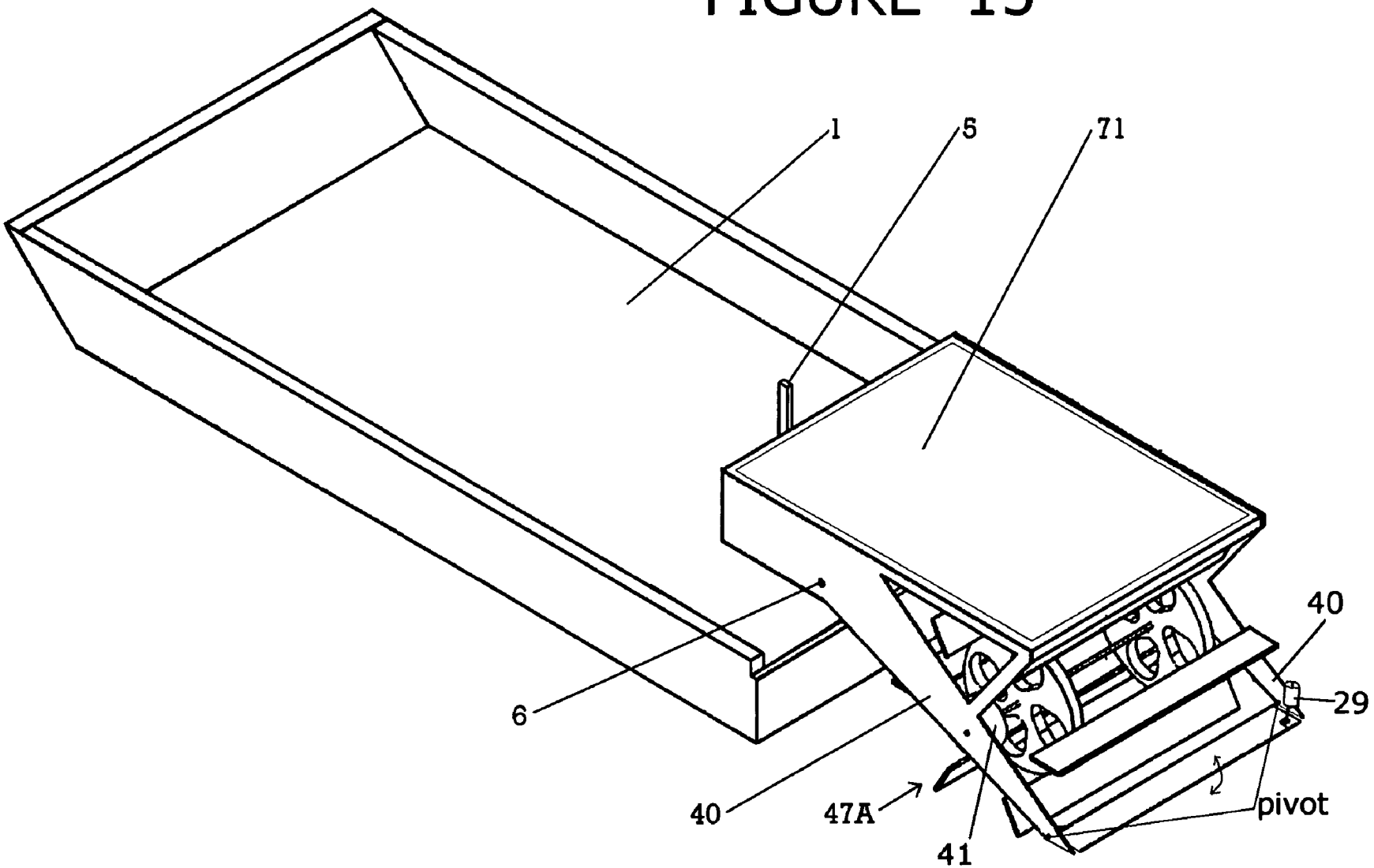
FIG. 15 shows a highly tunable thruster.

In FIGS. 14 and 15 the fin (51) is also allowed to pivot and a fin positioner (29) regulates the fin (51) while being attached to the support (40). In FIG. 14 a sensor (52) detects thruster undulation and provides signal to a control possessor (53) that drives the fin positioner (29) with energy provided by the Battery (70) aboard the vessel (1). In FIG. 15 the control processor (53) drives the fin positioner (29) in an adaptive manner based off the paddlewheel motors (41) draw (amperage) and speed (voltage).

It is believed that the following additional information regarding design principles that underlie the present invention, and the manner in which those design principles can be applied to a paddlewheel thruster, will be further useful to those in the art seeking to apply the principles of the present invention.

Paddlewheels are primarily surface displacing pumps that effect and are affected by displacement. A paddlewheel digs a hole in the water when thrust is greater then speed, (slippage). Therefore the paddlewheel trim is reduced by slippage.

With self trimming when flotation is used the buoyancy of the paddlewheel assembly will adjust to the hole, however if slippage is too great the buoyancy could be over come and trim would be lost. A fin is useful approach to addressing slippage because its lift effect is causal to thrust generated and further directs the displaced water. So if the buoyant mass is only sufficient to float the paddlewheel in trim when static, the fin maintains reasonable trim regardless of slippage, by providing lift directly related to thrust produced by the paddlewheel and so augmenting the buoyant mass.

The self trimming paddlewheel thruster trims itself automatically, without manual adjustment, substantially regardless of the static displacement of the vessel as well as the dynamic displacement of the vessel as it is accelerated and the state of the seas. The self trimming paddlewheel thruster is not fully independent of the displacement of the vessel, i.e. a vessel with a large variability in water displacement must have a thruster with a large trim movement range and if the vessel should overturn or sink the thruster probably would not remain in trim.

Self trimming of a paddlewheel can be accomplished in a very great many ways when a connection with the vessel allows a range of linear and or pivotal motion to the support of the paddlewheel for trim. From a buoyant mass that floats the paddlewheel to very complex feed back systems using a variety of sensors and controls can be used to maintain proper trim.

A paddlewheel that is out of trim is inefficient and manifest itself in several ways including splash, noise, surging and increased power requirements. These symptoms are detectable. Sensors can assist causal and acausal control systems to address efficiency.

There are four basic means to enable a paddlewheel thruster that is allowed a range of motion for trim by its connection with the vessel to self trim: 1. a buoyant mass that floats the paddlewheel, 2. a fin that provides lift to the paddlewheel from the thrust created by the paddlewheel, 3. a sensor with a control that regulates the range motion allowed by the connection with the vessel or range of motion allowed to the buoyant mass or the fin, 4. and a counter balance that introduces a balance moment to the thruster over the connection with the vessel. These four basic control means can be blended and combined in a multitude of ways each having distinct advantages.

The self trimming thruster is in the least complex implementation utilizing floatation actuation for trim is an example of a causal system of adaptive control. Conversely at the other end of complexity an acausal system utilizing adaptive intelligent programming, fuzzy logic or artificial intelligence in conjunction with such sensing technologies as sonar, radar, ultrasonic, machine vision or other technologies to provide input to controls that could be virtually any type of or actuator including but not limited to electric motor, hydraulic servo, muscle wire, torque reactive linkage or other type of electromechanical servo control are well within the current state of the art. An acausal system can augment a causal system by anticipating and acting on such things as wave interaction with the paddlewheel without defeating the causal system providing either an optimal processor controlled trim, or a redundant (in case of malfunction) solely causal trim.

The methodology of control of trim is of far lesser importance than the effect proper trim control has on efficiencies in a paddlewheel propulsive system. Ancillary to the symptoms of an out of trim paddlewheel are systems to reduce or compensate for the symptoms. All of which impact in a negative fashion on overall functionality by reducing the units propulsive efficiency by forcing the reduction of paddle count or increasing weight and complexity by adding shrouds and splash guards or by gross increase in wheel diameter causing weight and packaging issues.

With the paddlewheel properly trimmed a smaller wheel can be utilized and energy requirements are reduced as are structural loads on the supporting structure. This allows smaller lighter thruster increasing vessel efficiency at the same performance levels or a higher level if reduction in power and weight are not the engineering goal. In either case a lighter more energy efficient package or a more powerful package can be produced than with non self trimming arrangements.

This technology is independent of paddlewheel or vessel construction. When paddlewheel and vessel design are integrated with this trimming technology additional increases in efficiency's or performance follow. Now a person can create a hover or hydrofoil vessel, effectively and efficiently propelled with a paddlewheel. The self trimming paddlewheel thruster can utilize any paddlewheel and endless line paddlewheel designs from the most simple to complex articulated paddles. All paddlewheel designs will demonstrate increased efficiency because they are constantly and automatically trimmed reducing less effective work.

It should be noted that placing a fin behind the paddlewheel will increase the efficiency of any paddlewheel design by directing the water as it leaves the paddlewheel and also has the added benefit of reducing the waves formed by the rotating paddlewheel.

Motive power is not restricted in any fashion utilizing these technologies from batteries and solar all the way to nuclear steam propulsion this technology is completely scalable to suit any propulsive motor or engine and drive train system.

Environmental impact is reduced when compared to high rpm internal combustion powered screw propeller equipped vessels and solar powered paddlewheel equipped vessels. From manatees to photosynthetic smog impact is greatly reduced, because paddlewheels are highly efficient, generally safer for aquatic life because of lower rpm, tip speed.

The concept of a self trimming paddlewheel thruster can be further improved by allowing a second range of motion for twist. Allowing a greater range of motion enables the thruster a greater ability to react if it strikes an object, and to better trim thru wave formations. Allowing a range of motion to the thruster can reduce the likelihood of the thruster, the vessel and or the foreign object being damaged when a foreign object is struck.

Steering of a traditional paddlewheel propelled vessel is difficult at best when the paddlewheel can not be repositioned to directionally apply thrust. With the present invention, by allowing the connection with a vessel a second range of motion for steering and an ability to control the steering so that the self trimming paddlewheel thruster can directionally apply its thrust to the vessel makes the vessel highly maneuverable. Allowing a third range of motion, twist, may still be desirable and having an ability to control the twist can further assist with steering by forcing one end (side) of the paddlewheel to dig, thereby increasing the steering effect.

A means to stow a self trimming paddlewheel thruster may be desired, and can be accomplished by incorporating a means to lift and retain the thruster and allowing the connection with the vessel the required range of motion.

The connection with the vessel need not be permanent. Self trimming paddlewheel thrusters can be made to clamp to a vessel or other forms of attachment can be used.

The self trimming paddlewheel thruster can be fully scaled capable of propelling any floating object.

Integration with onboard ship navigation, auto-pilot and collision avoidance systems is a natural extension of the electronic implementation of this technology. From tiller steering to fly by wire and remote unmanned vessels this technology remains viable.

The self trimming paddlewheel thruster can be a self powered device and or it can comprise a drive train that is driven from a vessels power source. Further the self trimming paddlewheel thruster can employ motors and or engines in the thruster or onboard the vessel or both.

The self trimming paddlewheel thruster need not have an external power source because it can incorporate ambient energy capturing devices such as photovoltaics or wave or current energy capturing devices, etc. . . . or can utilize the energy capturing devices aboard the vessel to which it is attached or can receive storable power from other sources.

The self trimming paddlewheel thruster can comprise energy storage devices such as fuel tanks or batteries, springs, etc. . . . or can be configured to utilize the storage devices aboard the vessel to which it is attached The self trimming paddlewheel thruster can be configured to be a device that also provides electrical energy to a vessel.

Trim sensors may have many forms such as devices that indicate; thrust, vessel displacement, the levelness of the vessel, paddlewheel engagement to water, drive load, drive load pulsations, speed, cavitations, connection stress, vessel motion, noise, etc. . . .

Sensors can be connected with control devices directly, thru linkages or thru control processors which can analyze the input signals and provide drive to the controls and also may control the paddlewheel drive and other systems aboard the vessel. The control processors abilities can include causal and acausal methodologies depending on the signals collected.

The self trimming thruster may comprise the control processor or the processor can be placed aboard the vessel that the thruster is attached to.

Accordingly, the foregoing description provides an example of how the principles of the present invention can to used to form several types of paddlewheel thrusters, and describes various ways those principles can be applied to the design and operation of paddlewheel thrusters. With the foregoing disclosure in mind, it is believed that various adaptations of a paddlewheel thruster, according to the principles of the present invention, will be apparent to those in the art.

What is claimed is:

1. A self trimming paddlewheel thruster for propelling a vessel comprising:

a paddlewheel rotatable about at least one horizontal axis of rotation, a paddlewheel drive that rotates the paddlewheel, a support frame, a connection device configured to attach the support frame to the vessel in a manner that allows the thruster to trim, and a trim device configured to adjust the paddlewheel engagement into water automatically and substantially independent of the displacement of the vessel to allow optimum thrust production by the paddlewheel; furthermore, the said trim device comprising at least one buoyant mass affixed to a lateral portion of the support frame.

2. The thruster of claim 1 further comprising at least one the following four trim devices:

a fin providing direction to water and generating a lift force as the water flows past the fin, a balance device in the form of counterbalance over the connection device, a control configured so that the range of motion provided by the connection device is limited, a sensor connected with at least one control actuator that regulates an other element of the thruster for trimming of the paddlewheel.

3. The thruster of claim 2 further comprising at least one the following seven variations:

the at least one buoyant mass primarily having a form being elongated and extending in a substantially vertical plane that is perpendicular to the axis of rotation of the paddlewheel, the connection device further configured to allow the support to pivot about an axis extending substantially in the direction of thrusts, the connection device further configured to allow the support to pivot in a manner to enable the thruster to steer the vessel, the connection device further configured to allow the support to stow the paddlewheel out of the liquid, the connection device further configured to be removably attachable to the vessel, the thruster further comprising an electricity producing transducer, and the thruster further comprising an energy storage device.

4. The thruster of claim 1 further comprising at least one the following seven variations:

the at least one buoyant mass primarily having a form being elongated and extending in a substantially vertical plane that is perpendicular to the axis of rotation of the paddlewheel, the connection device further configured to allow the support to pivot about an axis extending substantially in the direction of thrusts, the connection device further configured to allow the support to pivot in a manner to enable the thruster to steer the vessel, the connection device further configured to allow the support to stow the paddlewheel out of the liquid, the connection device further configured to be removably attachable to the vessel, the thruster further comprising an electricity producing transducer, and the thruster further comprising an energy storage device.

5. A self trimming paddlewheel thruster for propelling a vessel comprising:

a paddlewheel rotatable about at least one horizontal axis of rotation for providing a propulsive thrust, a paddlewheel drive that rotates the paddlewheel, a support frame, a connection device configured to attach the support frame to the vessel in a manner that allows the thruster to trim independently from the vessel, and a trim device configured to trim the paddlewheel engagement into water automatically and substantially independent of the displacement of the vessel; furthermore, the said trim device comprising a fin providing direction to the water and generating lift forces as the water flows past the fin, and at least one of the following three trim devices:

a balance device in the form of counterbalance over the connection device, a control configured so that the range of motion provided by the connection device is limited, a sensor connected with at least one control actuator to regulate an other element of the thruster for trimming of the paddlewheel.

6. The thruster of claim 5 further comprising at least one the following six variations:

the connection device further configured to allow the support to pivot about an axis extending substantially in the direction of thrusts, the connection device further configured to allow the support to pivot in a manner to enable the thruster to steer the vessel, the connection device further configured to allow the support to stow the paddlewheel out of the liquid, the connection device further configured to be removably attachable to the vessel, the thruster further comprising an electricity producing transducer, and the thruster further comprising an energy storage device.

7. A vessel with the thruster as in claim 1, 2, 4, 3, 5, or 6 comprising:

at least one sensor upon the vessel providing a variable signal derived from its environment and being connected with at least one control processor that processes the variable signal and provides commands to at least one control actuator that regulates an other element of the thruster for trimming the paddlewheel.

8. A vessel with the thruster as in claim 1, 2, 4, 3, 5, or 6 further comprising:

at least one sensor (such as radar, sonar, or GPS) connected with at least one control processor connected with at least one control actuator that regulates the thruster to provide automated pilot functions.

* * * * *